US012543846B2

(12) United States Patent
Baker et al.

(10) Patent No.: US 12,543,846 B2
(45) Date of Patent: Feb. 10, 2026

(54) HAIRBRUSH

(71) Applicants: Kyle Joseph Baker, San Antonio, TX (US); Roberto Enrique Buenrostro, San Antonio, TX (US)

(72) Inventors: Kyle Joseph Baker, San Antonio, TX (US); Roberto Enrique Buenrostro, San Antonio, TX (US)

( * ) Notice: Subject to any disclaimer, the term of this patent is extended or adjusted under 35 U.S.C. 154(b) by 696 days.

(21) Appl. No.: 17/583,635

(22) Filed: Jan. 25, 2022

(65) Prior Publication Data

US 2022/0232965 A1 Jul. 28, 2022

Related U.S. Application Data

(60) Provisional application No. 63/141,247, filed on Jan. 25, 2021.

(51) Int. Cl.
*A46B 15/00* (2006.01)

(52) U.S. Cl.
CPC .... *A46B 15/0061* (2013.01); *A46B 2200/104* (2013.01)

(58) Field of Classification Search
CPC ..... A46B 15/0061; A46B 17/08; A46B 2200/104; A46B 15/00; A45D 8/002; A45D 8/18; A45D 8/185
USPC ..... 132/147, 242, 311, 313
See application file for complete search history.

(56) References Cited

U.S. PATENT DOCUMENTS

| | | | | |
|---|---|---|---|---|
| 2,612,175 | A * | 9/1952 | Martino | A45D 24/10 132/147 |
| 2,821,203 | A * | 1/1958 | Kesterson | A45D 24/10 132/122 |
| 2,843,136 | A * | 7/1958 | Limburg | A45D 8/18 D28/75 |
| 6,014,785 | A * | 1/2000 | Punch | A46B 15/0055 7/105 |
| 6,189,542 | B1 * | 2/2001 | Shepard | A45D 8/20 132/273 |
| 2010/0050352 | A1 * | 3/2010 | Deris | A46B 15/0065 132/316 |
| 2013/0000664 | A1 * | 1/2013 | Velazquez | A45D 24/34 132/271 |
| 2014/0261513 | A1 * | 9/2014 | Lammon | A45D 44/00 224/183 |
| 2017/0367468 | A1 * | 12/2017 | Accetura, Jr. | A46B 5/002 |
| 2018/0037385 | A1 * | 2/2018 | Maas | A47G 25/005 |
| 2019/0075922 | A1 * | 3/2019 | Rivera | A46B 15/0042 |

* cited by examiner

*Primary Examiner* — Brian D Keller
*Assistant Examiner* — Aaron R McConnell
(74) *Attorney, Agent, or Firm* — Jackson Walker LLP

(57) ABSTRACT

A hairbrush with novel storage solutions integrated into the handle and body, as well an integrated magnetic collector for recovering dropped or spilled hair accessories.

6 Claims, 3 Drawing Sheets

HAIRBRUSH

This application is based upon and claims priority from U.S. Provisional application Ser. No. 63/141,247, which is incorporated herein by reference.

BACKGROUND OF THE INVENTION

Field of the Invention

Applicants' invention relates to a device for a brush and storage device combination.

Background Information

Maintaining hairstyles, in particular long hair, requires numerous accessories. A hair brush for styling, clips to hold hair in place, elastic bands to make ponytails or other styles, pins for support, and various colors of each to match an outfit. The result is that users must maintain, and organize, a large collection of items—making styling on the go a difficult task.

The "home remedy" for this problem typically involves wrapping elastic bands around the brush's handle. Unfortunately, this stretches the bands, shortening their useful life. Some manufacturers have added hollow cavities to brush handles, however this provides very limited storage and is difficult to access while in the act of styling. Inevitably, both approaches require users to carry a separate container of clips, pins, bands, etc. along with the brush. This provides adequate storage, but requires additional space and runs the risk of being misplaced or lost.

SUMMARY OF THE INVENTION

This invention offers an improvement over the traditional brush. By incorporating novel storage solutions into the body of the brush, this invention provides a secure and convenient method of transporting an assortment of accessories along with a hairbrush. Specifically, the invention contains:

Axial clip mounts along the brush body. This enables clips to be attached to the brush via one or more mounting points. These are designed to be low profile, in order to reduce the potential for clips to snag on other items.

Axial band mounting points for elastic bands. The design of the band mounts provides secure fit while reducing the elongation of bands, which prevents "stretching" and premature failure. The mounts are situated near the axial clips, if present, to enable the clips to overlap the bands.

A pin clip in the handle of the brush. This enables bobby pins, or similar devices, to be attached to the handle of the brush. The clip is designed to provide secure mounting while preserving easy access. The pin clip is oriented to provide easy access while the brush is in use. This differs from existing solutions with in-handle storage that requires the storage to be accessed while the brush is not in use. The mounts are spaced in such a manner as to permit hair clips to sit flush with the brush body and not interfere with one another. Clips can be mounted on both sides of the brush, or on only one side.

A storage compartment in the brush body. This compartment is comprised of a recessed body and a door, which enables the contents to be securely stored. The compartment body can be configured as a single large compartment or contain internal organization features. The in-body storage compartment is oriented to be accessible in an ergonomic manner while the brush is in use, with minimal potential for the access door or compartment to snag on hair. The storage compartment is comprised of two primary parts: a recessed compartment in the brush body, and a hinged door that encloses the compartment. A closure latch secures the door, when shut.

A magnetic "pick-up" point. A magnetic insert may be embedded in the brush body or secured in place within the internal cavity of the brush body. This enables the brush to collect pins, clips, and other accessories that might become lost or spilled in a drawer, bag, or other location.

The invention is, at its core, a traditional hairbrush. It consists of a body, a handle, and a bristle crown with an assortment of bristles. The brush body is typically made from a plastic or resin, although other material choices are possible. The bristle crown is typically made from rubber or elastomer with rigid bristles. Where it deviates from other brushes is the integration of novel storage solutions throughout the brush. These storage points are typically integrated into the brush, rather than attached as separate components. The storage solutions are arranged in three primary segments: axial, in-body, and in-handle.

The axial storage components, specifically the clip and band mounts, provide the ability to affix accessories externally to the outer perimeter of the brush. Elastic bands are affixed via an inset and/or protruded mounting points. Typically, two per side located near the first and second ends of the brush body, although other arrangements are possible, in order to secure various sizes of bands. The mounting points are positioned to provide adequate tension to prevent elastic bands from falling off, but not so much as to result in stretching damage.

Additional axial storage is offered by the clip mounts 9. These mounts protrude from the body and contain an overhanging feature 10 through which hair clips or other accessories can be fastened. The overhang is typically joined to the body at the clip mount's first 9 and second 11 end along the outer edge of the brush body 16. The mounts are typically positioned close enough to the brush body to enable clips to exert force against the body, for a secure fit. The mounts may be free standing or may overlap the band mounting points, in order to provide additional reinforcement to the band mounting.

In-body storage is offered through a storage compartment that is integrated into the brush body. This compartment has a hinged door, which enables the compartment to be securely closed. The internal volume of the compartment can be uninterrupted or contain various organizational features. The compartment can be designed to be completely sealed with a gasket, offering a waterproof storage option, or it can be vented for drainage purposes. The compartment is located within the body of the brush, in order to utilize the void space beneath the bristles.

DETAILED DESCRIPTION OF THE PREFERRED EMBODIMENT

| | |
|---|---|
| 1 | handle |
| 2 | handle second end |
| 3 | neck first end |
| 4 | neck |
| 5 | neck second end |
| 6 | axial band mount |
| 7 | head |
| 8 | shoulder |
| 9 | axial clip mount |
| 10 | clip mount ceiling |
| 11 | clip mount edge |
| 12 | head second end |
| 13 | magnet |
| 14 | compartment first side |
| 15 | compartment |
| 16 | body |
| 17 | latching interface |
| 18 | perimeter |
| 19 | head first end |
| 20 | hair pin magazine |
| 21 | collar |
| 22 | aperture |
| 23 | handle first end |
| 24 | hinge |
| 26 | pin clip third end |
| 27 | pin clip first end |
| 28 | pin clip lower floor |
| 29 | pin clip second end |
| 30 | pin clip upper floor |
| 31 | latch |
| 33 | door |
| 34 | brush |
| 35 | compartment third side |
| 36 | compartment second side |
| 37 | compartment fourth side |
| 39 | clip mount lower wall |
| 40 | clip mount upper wall |
| 44 | aperture |
| 50 | clip mount void space |
| 51 | bristle |

Figure 1A:
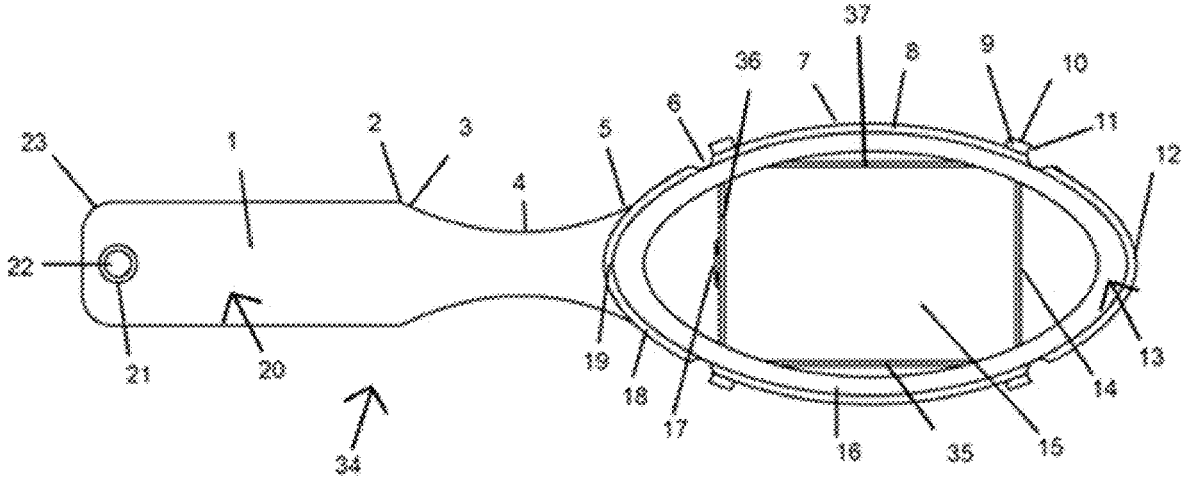
FIG. 1A is a top view of a first embodiment of the improved brush.
Figure 1B:
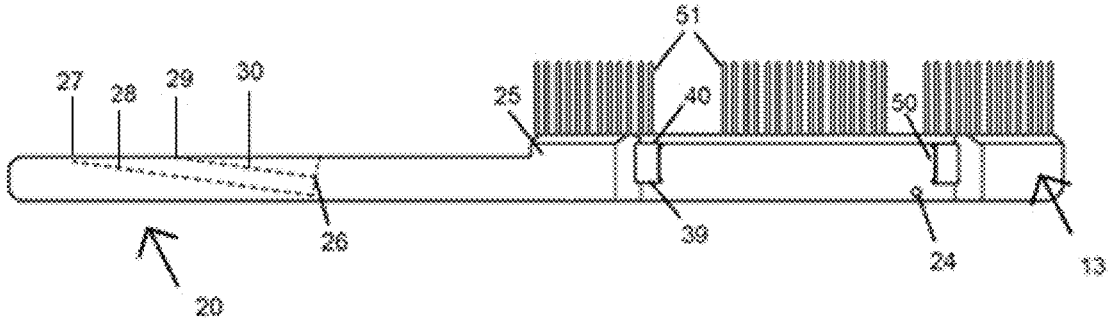
FIG. 1B is a side view of a first embodiment of the improved brush.
Figure 1C:
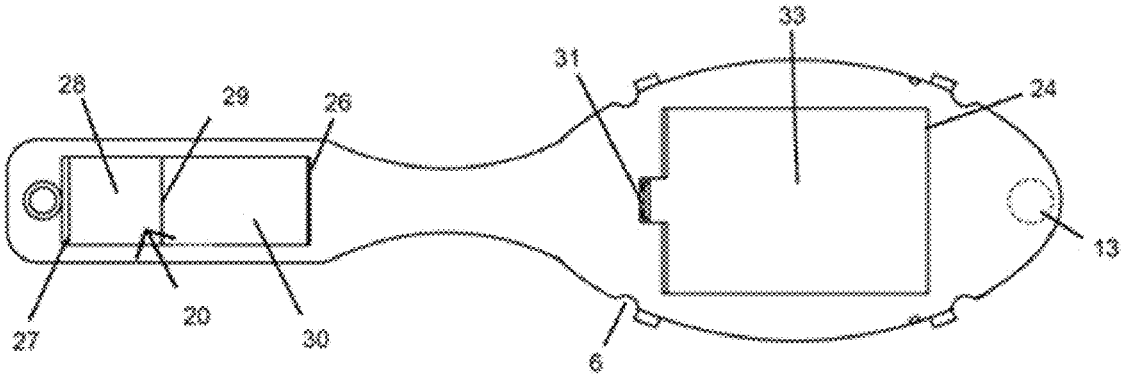
FIG. 1C is a bottom view of a first embodiment of the improved brush.

Referring to the figures, FIG. 1A illustrates an overall illustration of a first embodiment of the features when combined into a single brush which encompasses the following elements: (I) axial clip mounts, (II) axial band mounts, (III) a handle that contains a magazine for hair pins, and (IV) a compartment and door that are located within the back body of the brush. The combination of one or more of these features into a single brush represents an improvement over existing in-brush storage solutions. The placement of axial clip mounts 9 around the body 16 of the brush 34 and in immediate proximity to the axial band mounts is illustrated. The mounts are placed in such a manner as to allow the clips to overlap the band mounts, providing a more secure storage option for bands. FIG. 1B illustrates axial band mounts placed along the outer body of the brush head. FIG. 1C illustrates the handle-mounted pin clip and an in-body storage compartment, as well as an embedded magnetic pick-up point.

In this first embodiment, the brush 34 is generally comprised of a handle 1, a neck 4, and a head 7. The handle 1 has a first end 23 and an opposing second end 2. It is anticipated that the handle 1 may have an aperture 44, near the first end 23, where the aperture 22 is defined by a circumferential collar 21 that allows a lanyard (not shown) to be attached to the brush 34 by inserting the lanyard (not shown) through the aperture 22.

The neck 4 has a first end 3 and a second end 5. The neck first end 3 is connected to the handle second end 2, while a first end 19 of the head 7 is attached to the neck second end 5. The second end 12 of the head 7 is positioned generally linearly, opposite from the handle first end 23.

In certain embodiments, the neck 4 may be virtually indistinguishable from the handle 1, or there may be no neck 4, and the handle 1 is attached at its second end 2 to the first end 19 of the head 7.

The body 16 portion of the head 7, is a shaped member bounded by a circumferential shoulder 8. As shown more clearly in FIG. 1B, the body 16 has a volume. As with conventional brushes generally, one side of the head 7 has a plurality of bristles 51 extending outwardly in one direction for brushing hair. Inside the shoulder 8, the body 16 has a compartment 15, which is defined by sides: first side 14 and second side 36. The sides 14 and 36 are connected by relatively perpendicular, third side 35 and fourth side 37. The compartment 15 includes a latching interface 17 which helps secure a door 33. Door 33 is typically connected to the body 16 of the brush 34 by a hinge 24. Possible alternative arrangements do not feature a hinge 24 and instead feature a removable door 33. The door 33 additionally contains a latch 31 that secures the door 33 to the brush body 16 at the latching interface 17. Compartment 15 is enclosed by the brush body 16 and the door 33.

Within the volume of the brush body 16 may be a magnet 13 which may be situated near the second end 12 of the brush head 7 and linearly opposite the handle first end 23. This placement is more clearly illustrated in FIG. 1C. The integrated magnet 13 enables users to quickly collect dropped or spilled metallic hair accessories. The magnet 13 can be exposed or enclosed within the body 16, and is typically placed opposite from the brush handle 1.

The outer perimeter 18 of the brush body 16 includes a plurality of axial band mounts 6. The axial band mounts 6 may be adjacent to a plurality of axial clip mounts 9 that are joined to the axial band mounts 6 at edge 11. The axial clip mounts 9 are defined by a lower wall 39 and upper wall 40 which are connected by a ceiling 10 and create a void space 50.

The hair pin magazine 20 is located in, and embedded into, the brush's handle 1. This compartment comprises a lower floor 28 and an upper floor 30. The floors 28 and 30 can be smooth or textured in order to offer increased hold on the pins. It can be configured as a single compartment or divided into multiple sections. Within the handle 1 of the brush 34, situated between the neck 4 and the aperture 22, is the hair pin magazine 20. The hair pin magazine 20 is generally comprised of a lower floor 28 and an upper floor 30. The hair pin magazine 20 has a first end 27 and a third end 26. The lower floor 28 is defined by a first end 27 and a third end 26. The upper floor is defined by a second end 29 and third end 26. The upper floor 30 is generally shorter in length than the lower floor 28. The hair pin magazine 20 is set at an angle that recesses third end 26 into the body of the handle 1. In one embodiment, the hair pin magazine 20 first end 27 and second end 29 are not recessed into the handle 1, while the third end 26 is recessed into the handle 1. In another embodiment, the hair pin magazine 20 is set at an angle such that the third end 26 is recessed into the handle 1 more deeply as compared to the upper floor 30 first end 29. In another embodiment, the hair pin magazine 20 is set at an angle such that the third end 26 is recessed into the handle 1 more deeply as compared to the upper floor 30 first end 29, and the third end 26 is recessed into the handle more deeply as compared to the lower floor 28 first end 27. The angle is illustrated in FIG. 1B. In other embodiments, as shown in FIG. 2 and FIG. 3B, the hair pin magazine 20 first end 27 and second end 29 are recessed into the handle 1, but not as deeply as the third end 26.

Figure 2:
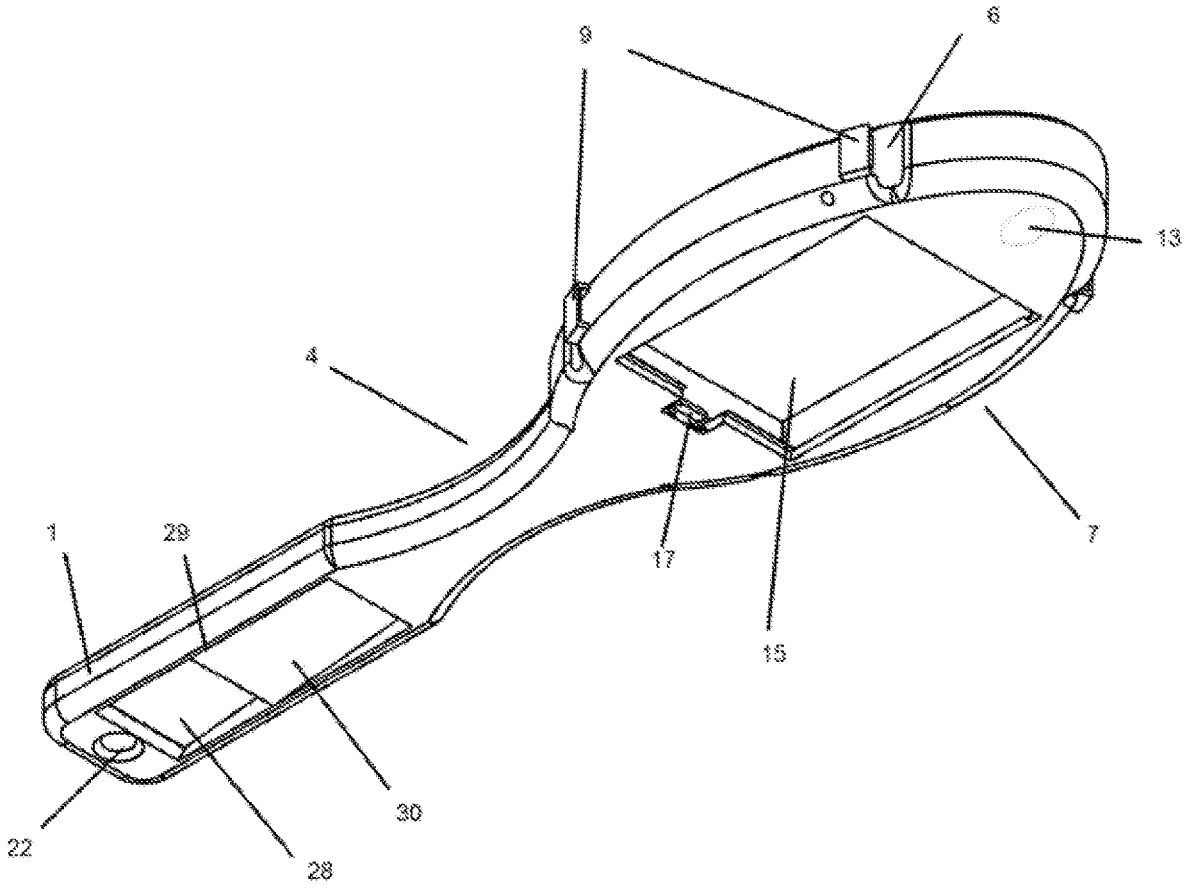
FIG. 2 is a perspective view illustrating the bottom of the improved brush.

FIG. 2 is a perspective view of the combined invention. Shown are the handle 1, neck 4, and head 7. Axial band mounts 6 and axial clip mounts 9 are located along the outer edge of the brush head 7. Inset into the body 16 is the storage compartment 15 with latching interface 17. The door 33 is not pictured in this drawing. Within the handle 1 is the hair pin magazine 20. The lower floor 28 and upper floor 30 are illustrated. The aperture 22 is illustrated at the first end of the handle.

Figure 3A:
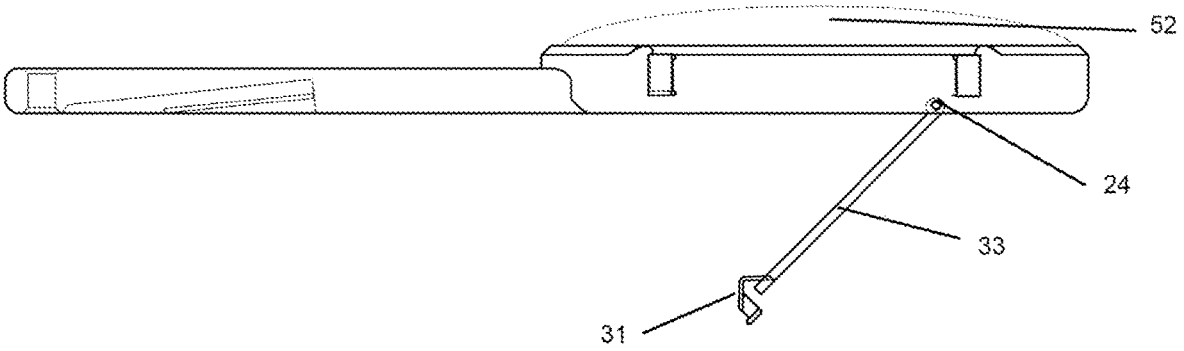
FIG. 3A is a side view of the improved brush with door attached and open.
Figure 3B:
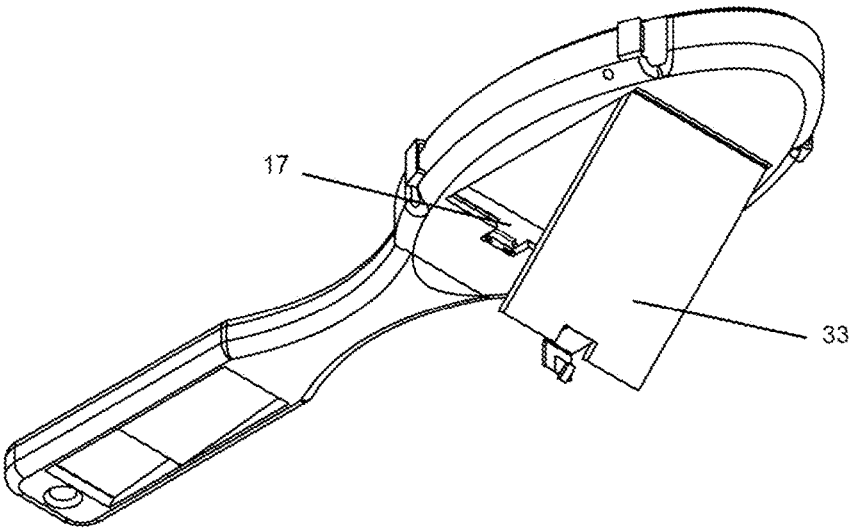
FIG. 3B is a perspective view illustrating the improved brush with door attached and open.

FIGS. 3A and 3B illustrate the invention with a door 33 installed and in the open position. The door 33 rotates around a hinge 24 such that it is rotatably attached to the body at an end of the compartment 15. When parallel with the body, in the "closed" position, the door 33 would be secured by the latching interface 17 and latch 31 and covers the compartment 15. Possible variations of the latching interface 17 and latch 31 include magnetic closures, hook and loop fasteners, friction locks, slide locks, or other means of securing the door 33. In variations with a removable door 33, the hinge 24 is replaced by an second latching interface (not shown) which may or may not be identical to the latching interface 17 and latch 31. An optional bristle crown 52 is shown in place in this view. In this embodiment, the bristles 51 (not shown in this Figure) would be attached at one end to the bristle crown 52 and extend outwardly.

The terms "a" or "an" when used in conjunction with the term "comprising" in the claims and/or the specification may mean "one," but it is also consistent with the meaning of "one or more," "at least one," and "one or more than one."

The term "each" refers to each member of a set, or each member of a subset of a set.

The terms "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

In interpreting the claims appended hereto, it is not intended that any of the appended claims or claim elements invoke 35 U.S.C. 112(f) unless the words "means for" or "step for" are explicitly used in the particular claim.

It should be understood that, although exemplary embodiments are illustrated in the figures and description, the principles of the present disclosure may be implemented using any number of techniques, whether currently known or not. The present disclosure should in no way be limited to the exemplary implementations and techniques illustrated in the drawings and description herein. Thus, although the invention has been described with reference to specific embodiments, this description is not meant to be construed in a limited sense. Various embodiments may include some, none, or all of the enumerated advantages. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

We claim:

1. A hair brush, comprising:

a body having a first end and a second end, wherein said body first end is attached to a handle;

a plurality of bristles extending in one direction outwardly from said body;

a hair pin magazine embedded into said handle;

wherein said hair pin magazine comprises:

a lower floor and an upper floor;

wherein said lower floor is defined by a first end and a third end, and said upper floor is defined by a second end and said third end;

wherein said upper floor is shorter in length than said lower floor;

wherein a recess is defined in said handle directly above said upper floor;

wherein said hair pin magazine is set at an angle such that said third end is recessed into said handle more deeply as compared to said lower floor first end and said upper floor second end.

2. The hair brush of claim 1, wherein said lower floor and said upper floor are textured.

3. The hair brush of claim 1, further comprising a magnet attached to said body second end.

4. The hair brush of claim 1, further comprising: a compartment in said body; a door having a first end that is rotatably attached to said body by a hinge at a first end of said compartment; a latch attached to a second end of said door opposite said hinge; and said latch being securable to a latching interface of said body at a second end of said compartment.

5. The hair brush of claim 1, further comprising: said body having a perimeter around its circumference; and a plurality of axial clip mounts attached to said perimeter, wherein said axial clip mounts comprise a lower wall and an upper wall which are connected by a ceiling, wherein there is a void space between said ceiling and said perimeter.

6. The hair brush of claim 4, further comprising: said body having a perimeter around its circumference; and a plurality of axial clip mounts attached to said perimeter, wherein said axial clip mounts comprise a lower wall and an upper wall which are connected by a ceiling, wherein there is a void space between said ceiling and said perimeter.

* * * * *